US011231668B2

(12) United States Patent
Miyauchi et al.

(10) Patent No.: US 11,231,668 B2
(45) Date of Patent: Jan. 25, 2022

(54) HEATING DEVICE, IMAGE PROCESSING APPARATUS, AND METHOD FOR CONTROLLING HEATING DEVICE

(71) Applicant: TOSHIBA TEC KABUSHIKI KAISHA, Tokyo (JP)

(72) Inventors: Chie Miyauchi, Kanagawa (JP); Osamu Takagi, Tokyo (JP); Ryota Saeki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/190,090

(22) Filed: Mar. 2, 2021

(65) Prior Publication Data

US 2021/0181660 A1 Jun. 17, 2021

Related U.S. Application Data

(63) Continuation of application No. 16/921,862, filed on Jul. 6, 2020, now Pat. No. 10,962,909, which is a (Continued)

(30) Foreign Application Priority Data

Oct. 20, 2017 (JP) ..... JP2017-204031

(51) Int. Cl.
*G03G 15/20* (2006.01)
*G03G 15/00* (2006.01)

(52) U.S. Cl.
CPC ..... *G03G 15/2039* (2013.01); *G03G 15/2042* (2013.01); *G03G 15/80* (2013.01)

(58) Field of Classification Search
CPC . G03G 15/2039; G03G 15/2042; G03G 15/80
See application file for complete search history.

(56) References Cited

U.S. PATENT DOCUMENTS 9,342,010 B2 5/2016 Shimura et al.
9,448,514 B2 9/2016 Ikebuchi et al.
(Continued)

FOREIGN PATENT DOCUMENTS

JP 2007-079035 A 3/2007
JP 2009-156963 A 7/2009
(Continued)

OTHER PUBLICATIONS

Extended European Search Report dated Apr. 18, 2019 in corresponding European Patent Application No. 18201223.7, 7 pages.
(Continued)

*Primary Examiner* — Francis C Gray
(74) *Attorney, Agent, or Firm* — Kim & Stewart LLP

(57) ABSTRACT

A heating device includes a belt, a heater that is in contact with an inner surface of the belt and divided into heater blocks in a width direction thereof, a pressing member that presses a sheet against the belt, a temperature sensor disposed on each of a number of the heater blocks that is at least one-half of the total number thereof, and a processor configured to select one or more of the heater blocks based on a width of the sheet, and select one or more temperature sensors disposed on one or more of the selected heater blocks having the non-paper passing region and control electric power supplied to said one or more of the selected heater blocks to protect against an excessive temperature rise in the non-paper passing region based on temperatures detected by the temperature sensors.

20 Claims, 10 Drawing Sheets

Related U.S. Application Data continuation of application No. 16/814,938, filed on Mar. 10, 2020, now Pat. No. 10,732,550, which is a continuation of application No. 16/109,971, filed on Aug. 23, 2018, now Pat. No. 10,620,572.

(56) References Cited

U.S. PATENT DOCUMENTS

| | | | | |
|---|---|---|---|---|
| 9,727,011 | B2 | 8/2017 | Ikebuchi et al. | |
| 9,804,544 | B2 | 10/2017 | Takagi | |
| 9,804,546 | B2 | 10/2017 | Saito et al. | |
| 10,488,792 | B2 | 11/2019 | Sako et al. | |
| 2013/0039674 | A1* | 2/2013 | Takami | G03G 15/2017 399/69 |
| 2013/0058672 | A1* | 3/2013 | Takada | G03G 15/2025 399/67 |
| 2013/0108299 | A1 | 5/2013 | Minagawa et al. | |
| 2013/0209124 | A1 | 8/2013 | Saito et al. | |
| 2014/0029968 | A1 | 1/2014 | Tamaki | |
| 2015/0185671 | A1 | 7/2015 | Ikebuchi et al. | |
| 2015/0261149 | A1* | 9/2015 | Seshita | G03G 15/2042 399/68 |
| 2016/0085187 | A1 | 3/2016 | Takagi | |
| 2016/0132007 | A1* | 5/2016 | Eiki | G03G 15/2053 399/329 |
| 2016/0327891 | A1 | 11/2016 | Ikebuchi et al. | |
| 2017/0363999 | A1 | 12/2017 | Miyauchi et al. | |
| 2018/0024482 | A1 | 1/2018 | Nakamoto et al. | |
| 2018/0032008 | A1* | 2/2018 | Sako | G03G 15/80 |
| 2018/0253043 | A1 | 9/2018 | Shimura et al. | |
| 2018/0335737 | A1 | 11/2018 | Ogura et al. | |
| 2019/0121267 | A1 | 4/2019 | Miyauchi et al. | |

FOREIGN PATENT DOCUMENTS

| | | | |
|---|---|---|---|
| JP | 2014056204 | A | 3/2014 |
| JP | 2016-065915 | A | 4/2016 |
| JP | 2016-133711 | A | 7/2016 |

OTHER PUBLICATIONS

Notice of Reasons for Refusal dated Apr. 20, 2021 in corresponding Japanese Patent Application No. 2017-204031, 10 pages (with Translation).

* cited by examiner

HEATING DEVICE, IMAGE PROCESSING APPARATUS, AND METHOD FOR CONTROLLING HEATING DEVICE

CROSS-REFERENCE TO RELATED APPLICATION

This application is a continuation of U.S. patent application Ser. No. 16/921,862, filed Jul. 6, 2020, which is a continuation of U.S. patent application Ser. No. 16/814,938, filed Mar. 10, 2020, now U.S. Pat. No. 10,732,550, issued on Aug. 4, 2020, which is a continuation of U.S. patent application Ser. No. 16/109,971, filed Aug. 23, 2018, now U.S. Pat. No. 10,620,572, issued on Apr. 14, 2020, which is based upon and claims the benefit of priority from Japanese Patent Application No. 2017-204031, filed Oct. 20, 2017, the entire contents of which are incorporated herein by reference.

FIELD

Embodiments described herein relate generally to a heating device, an image processing apparatus, and a method for controlling the heating device.

BACKGROUND

In a fixing device of the related art, a sheet is heated by a heater and a toner image on the sheet is fixed by the heat. If sheets having the same width are continuously printed, this causes a situation referred to as excessive temperature rise, in which the temperatures of a heater region located outside a region through which a sheet passes and a fixing belt in contact therewith increase excessively.

If the temperature rise in this non-paper passing region becomes excessive, irreversible performance deterioration such as warpage of a heater, deterioration in a fixing belt, and expansion of conveying and pressing rollers occurs.

DETAILED DESCRIPTION

Figure 1:
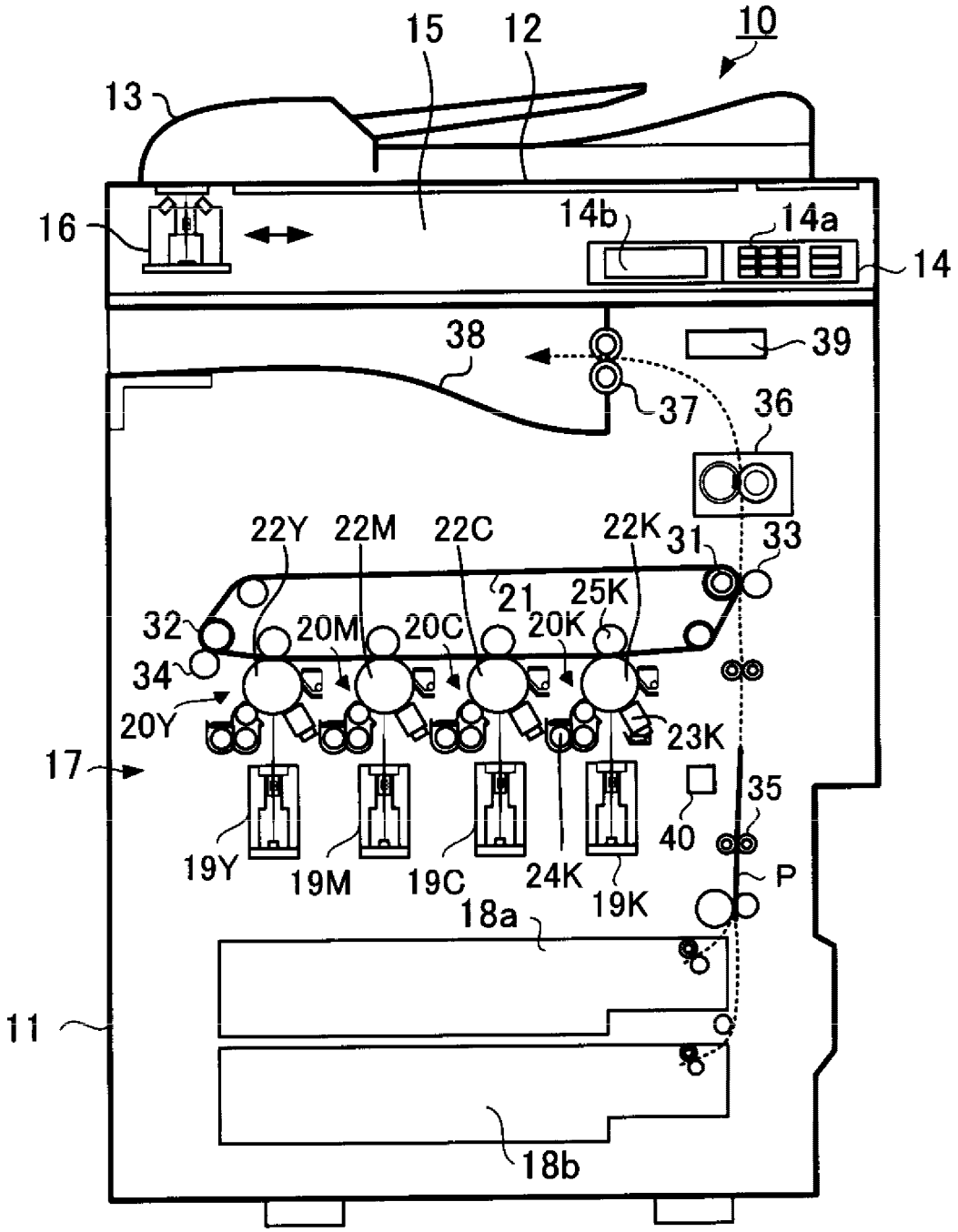
FIG. 1 is a diagram of an image forming apparatus including a fixing device according to an embodiment.

Embodiments provide a heating device that includes an endless belt, a heater that is in contact with an inner surface of the endless belt and divided into a plurality of heater blocks in a width direction of the belt, a pressing member that faces the belt and is configured to press a conveyed sheet against the belt, a temperature sensor disposed on each of a number of the heater blocks that is at least one-half of a total number of the heater blocks, and a processor configured to select one or more of the heater blocks based on a width of the conveyed sheet, and select one or more temperature sensors disposed on one or more of the selected heater blocks having the non-paper passing region and control electric power supplied to said one or more of the selected heater blocks having the non-paper passing region to protect against an excessive temperature rise in the non-paper passing region based on temperatures detected by the temperature sensors.

Hereinafter, embodiments will be described in detail with reference to FIGS. 1 to 17. In the following description, constituent elements having the substantially same function and configuration are given the same reference numeral, and repeated description will be performed as necessary.

In FIG. 1, an image forming apparatus 10 is, for example, a multi-function peripheral (MFP), a printer, or a copier. In the following description, the MFP will be described as an example.

A platen 12 of transparent glass is located at an upper part of a main body 11 of the image forming apparatus 10, and an automatic document feeder (ADF) 13 is provided to be openable and closable on the platen 12. An input/output control unit 14 is provided on the upper part of the main body 11. The input/output control unit includes an operation panel 14*a* having various keys for operating the image forming apparatus 10 and a touch panel type display portion 14*b*.

A scanner unit 15 is provided at a lower part of the ADF 13 in the main body 11. The scanner unit 15 includes, for example, a contact type image sensor 16 (hereinafter, simply referred to as an image sensor) in order to read a document fed by the ADF 13 or a document placed on the platen, so as to generate an image data. The image sensor 16 is disposed in a main scanning direction.

When reading an image of a document placed on the platen 12, the image sensor 16 is moved along the platen 12, and reads a document image line by line. This is performed over the entire document, and thus the document corresponding to one page is read. When reading an image of a document fed by the ADF 13, the image sensor 16 is located at a fixed position. The main scanning direction is a depth direction in FIG. 1 and is a direction orthogonal to a movement direction of when the image sensor 16 is moved below the platen 12.

A printer unit 17 is provided in a central part of the main body 11. The printer unit 17 processes image data read by the scanner unit 15 or image data received from a personal computer or the like over a network, and forms an image on a recording medium (for example, a sheet). A plurality of paper feeding cassettes 18 (two paper feeding cassettes 18*a* and 18*b* are illustrated in FIG. 1) for accommodating sheets of various sizes are provided in a lower part of the main body 11. A recording medium on which an image is formed includes an OHP (overhead projection) sheet or the like, but, in the following description, an example of forming an image on a paper sheet will be described.

The printer unit 17 includes scanning heads 19Y, 19M, 19C and 19K which have LEDs or laser devices as exposure devices for respective colors such as yellow (Y), magenta (M), cyan (C), and black (K), and generates images on photoconductors by applying light beams from the respective scanning heads 19 of the exposure devices. The printer unit 17 is, for example, a tandem type color printer, and includes image forming portions 20Y, 20M, 20C and 20K corresponding to respective colors. The image forming portions 20Y, 20M, 20C and 20K are arranged below an outer circumferential surface of an intermediate transfer belt 21 from the upstream side toward the downstream side in a moving direction of the intermediate transfer belt 21.

The intermediate transfer belt 21 is wound around a driving roller 31 and a driven roller 32, and is moved in a circulating manner. The outer circumferential surface of intermediate transfer belt 21 faces and is in contact with outer circumferential surfaces of photoconductive drums 22Y, 22M, 22C and 22K.

Since the image forming portions 20Y to 20K of the respective colors have the same configuration, the image forming portion 20K is described as an example. In this example, a charger 23K, a developer 24K, a primary transfer roller 25K, and the like are disposed around the outer circumferential surface of the photoconductive drum 22K. The scanning head 19K irradiates an exposure position of the photoconductive drum 22K with light, and thus an electrostatic latent image is formed on the photoconductive drum 22K.

The charger 23K charges an outer circumferential surface of the photoconductive drum 22K uniformly. The developer 24K supplies black toner to the photoconductive drum 22K with a development roller to which a development bias is applied, so as to develop the electrostatic latent image with the toner.

Toner cartridges (not illustrated) supplying toner to the respective developers 24Y to 24K are provided over the image forming portions 20Y to 20K. A primary transfer voltage is applied to a position of the intermediate transfer belt 21 facing the photoconductive drum 22K by the primary transfer roller 25K, and thus a toner image on the photoconductive drum 22K is transferred onto the intermediate transfer belt 21.

The driving roller 31 around which the intermediate transfer belt 21 is wound is disposed to oppose a secondary transfer roller 33. When a sheet P passes between the driving roller 31 and the secondary transfer roller 33, a secondary transfer voltage is applied to the sheet P by the secondary transfer roller 33. The toner image on the intermediate transfer belt 21 is transferred onto the sheet P. A belt cleaner 34 is provided near the driven roller 32 of the intermediate transfer belt 21.

A paper feeding roller 35 for conveying the sheet P fed from the paper feeding cassette 18 is provided in a conveying path reaching the secondary transfer roller 33 from the paper feeding cassettes 18. A fixing device 36 which is a heating device is provided on the downstream side of the secondary transfer roller 33. Conveying rollers 37 are provided on the downstream side of the fixing device 36, and the sheet P is discharged to a paper discharge portion 38 by the conveying rollers 37. The image forming apparatus 10 is controlled by a system control unit 39.

A size and a position of the conveyed sheet can be determined in real time by using a line sensor 40 disposed in a paper passing region.

The fixing device 36 of the present exemplary embodiment will be described later in detail. FIG. 1 illustrates an example of embodiments, and the embodiments are not limited to this example, and may use a structure of a well-known electrophotographic image forming apparatus.

Figure 2:
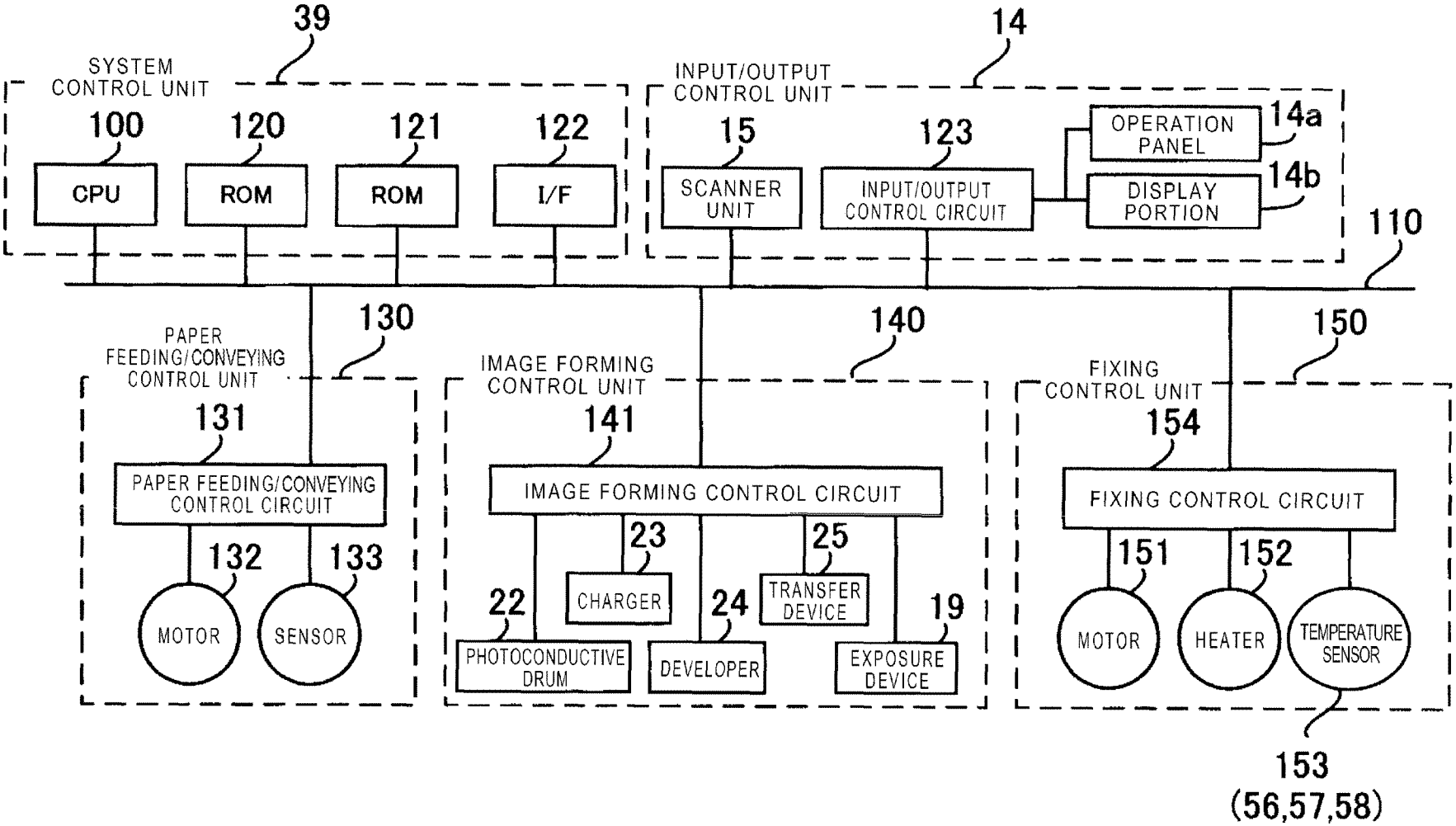
FIG. 2 is a block diagram illustrating a control system.

FIG. 2 is a block diagram illustrating a configuration example of a control system of the image forming apparatus 10 in the embodiment. The control system of the image forming apparatus 10 includes the system control unit 39, the input/output control unit 14, a paper feeding/conveying control unit 130, an image forming control unit 140, and a fixing control unit 150, which are connected to each other via a bus line 110.

The system control unit 39 includes, for example, a CPU 100 configured to control the entire image forming apparatus 10, a read only memory (ROM) 120, a random access memory (RAM) 121, and an interface (I/F) 122.

The CPU 100 executes a program stored in the ROM 120 or the RAM 121, so as to perform control of the entire apparatus including image forming control and fixing temperature control. The ROM 120 stores control programs, control data, and the like for image forming control and fixing temperature control. The RAM 121 is mainly used as a working memory for performing control of the entire apparatus.

The ROM 120 (or the RAM 121) stores, for example, a control program for the image forming portions 20Y to 20K or the fixing device 36, and various pieces of control data used by the control program. The I/F 122 performs communication with various devices such as a user terminal or facsimile.

The input/output control unit 14 controls the operation panel 14*a* and the display portion 14*b* connected to an input/output control circuit 123, and the scanner unit 15. An operator may operate the operation panel 14*a* so as to designate, for example, a sheet size or the number of copies of a document. The display portion 14*b* displays an operation state or the like of the image forming apparatus 10.

The paper feeding/conveying control unit 130 includes a paper feeding/conveying control circuit 131, a motor group 132, and a sensor group 133, and performs paper feeding control and paper conveying control. The paper feeding/conveying control circuit 131 controls the motor group 132 or the like driving the paper feeding roller 35 or the conveying rollers 37 on the conveying path. The paper feeding/conveying control circuit 131 controls the motor group 132 or the like according to a detection result in the various sensor group 133 in the vicinity of the paper feeding cassettes 18 or on the conveying path on the basis of a control signal from the CPU 100.

The image forming control unit 140 performs image forming control and includes an image forming control circuit 141 which controls the photoconductive drums 22, the chargers 23, the exposure devices 19, the developers 24, and the transfer devices 25 on the basis of control signals from the CPU 100.

The fixing control unit 150 performs fixing control and includes a motor 151, a heater 152 for heating, various temperature sensors 153 for detecting temperatures, and a fixing control circuit 154 which performs fixing temperature control and safety control.

Figure 3:
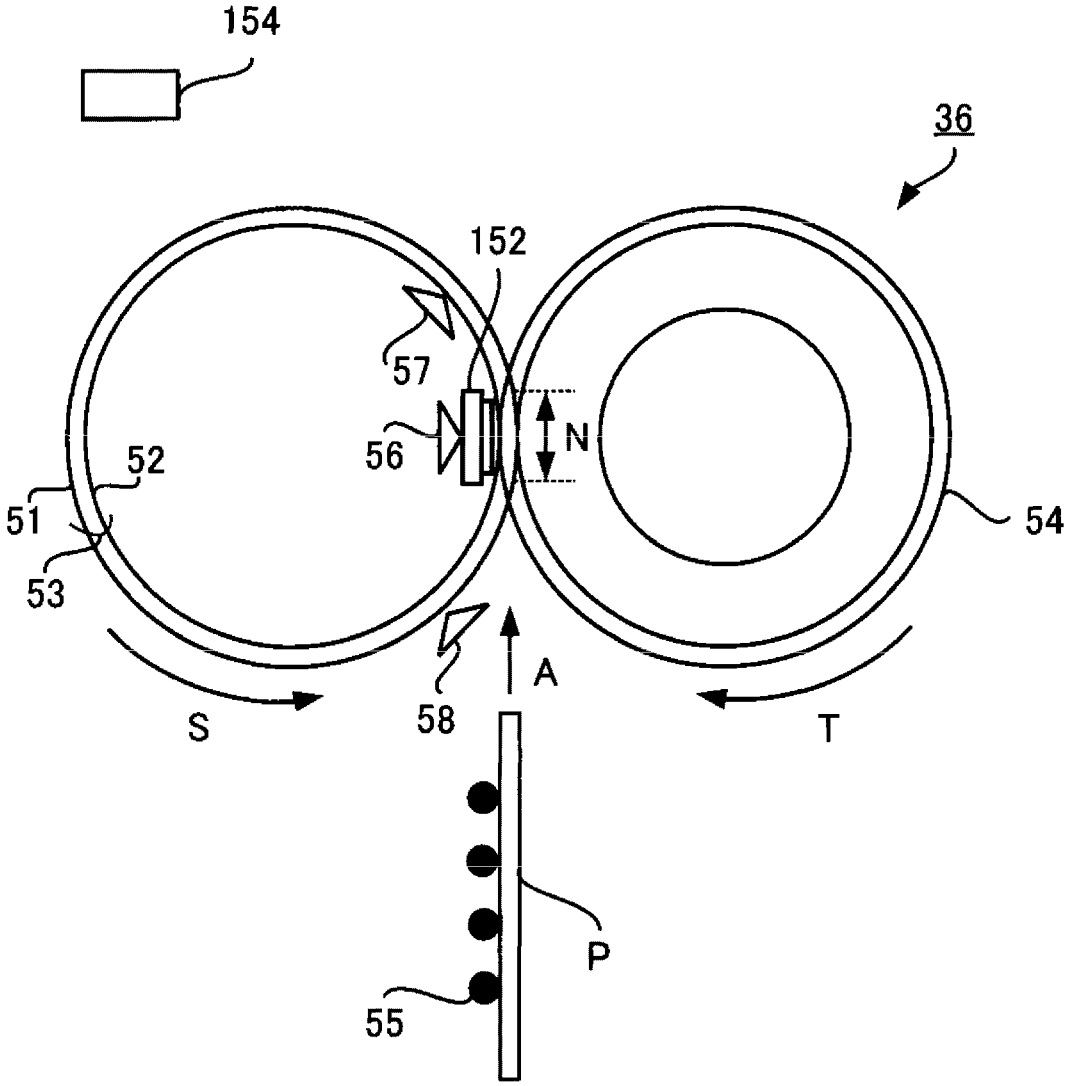
FIG. 3 is a configuration diagram illustrating an example of the fixing device.

FIG. 3 is a configuration diagram illustrating an example of the fixing device. As illustrated in FIG. 3, the fixing device 36 includes an endless belt 53 having an outer circumferential surface 51 and an inner circumferential surface 52, and a pressing roller 54 facing the belt 53. Drive force is transmitted to the pressing roller 54 from a motor (not illustrated), and the pressing roller 54 rotates in an arrow T direction.

In the endless belt 53, for example, a silicone rubber layer having a thickness of about 200 μm is formed on an outer part of a base material such as stainless used steel (SUS) having a thickness of 50 μm or polyimide heat-resistant resin having a thickness of 70 μm, and an outermost circumference thereof is coated with a protection layer such as perfluoroalkoxy (PFA). In the pressing roller 54, for example, a silicone sponge layer having a thickness of about 5 mm is formed on a surface of a steel rod having a diameter of 10 mm, and an outermost circumference thereof is coated with a protection layer such as PFA.

The fixing device 36 is provided with the heater 152, extending in a rotation axis direction of the belt 53, which is in contact with the inner circumferential surface 52 for increasing a temperature thereof. The endless belt 53 is configured to rotate in an arrow S direction while forming a fixing nip N with the pressing roller 54. When the sheet P passes through the fixing nip N in an arrow A direction, a toner image 55 transferred onto the sheet P is fixed to the sheet P by being heated by the heater 152 and being pressurized at the fixing nip N.

The temperature sensors 153 for detecting a fixing temperature can be configured in various forms. FIG. 3 illustrates a temperature sensor 56 which is disposed on a rear surface of the heater 152, a temperature sensor 57 which is disposed on the inner circumferential surface 52 and detects the temperature of the belt rear surface, and a temperature sensor 58 which is disposed on the outer circumferential surface 51 and detects the temperature of the outer circumferential surface.

The temperature sensor 56 is disposed on the rear surface of the heater 152, and thus its temperature measurement is not affected by rotation of the belt 53, and can detect a substantially constant temperature except when the sheet P passes through the region of the fixing nip N.

The temperature sensor 57 is disposed on the inner circumferential surface side. The temperature of the region of the fixing nip N with which the heater 152 is in contact is highest, and a temperature decrease is observed according to rotation of the belt 53.

Preferably, the temperature sensor 58 is not in contact with the outer circumferential surface of the belt 53 so as not to damage the belt 53. The temperature sensors 57 and 58 are required to be arranged in a moving direction of the belt 53 and separated from the fixing nip N, and thus temperature correction due to rotation of the belt 53 is necessary. The fixing device 36 is controlled by the fixing control circuit 154.

In the present embodiment, the temperature sensors 56, 57 and 58 may be selected as appropriate, or a plurality of types may be used together.

Figure 4:
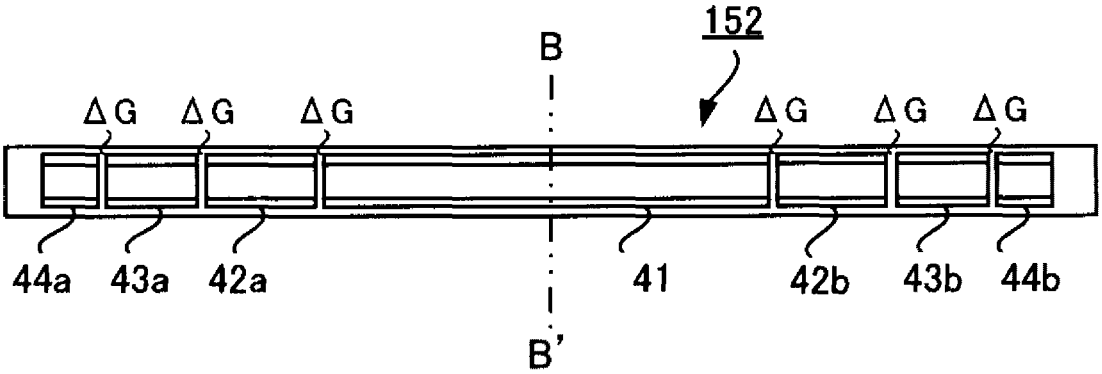
FIG. 4 is a plan view illustrating an example of a heater.
Figure 5:
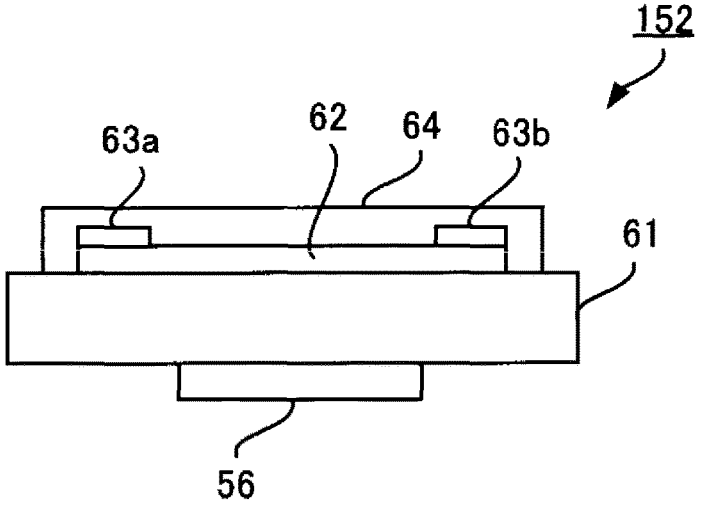
FIG. 5 is a sectional view illustrating an example of the heater.

FIGS. 4 and 5 are respectively a plan view and a sectional view illustrating an example of the heater. The heater 152 is divided into a plurality of heater blocks which are arranged symmetrically with respect to a heater central line (B-B') indicated by a two-dot chain line. In the present exemplary embodiment, as an example, the heater 152 is divided into seven blocks. Of course, this division number can be any number. If a conveying position of the sheet P is not at the center of the heater in a width direction orthogonal to the paper conveying direction, the heater blocks do not need to be disposed in a symmetrical manner.

In the heater 152 divided into a plurality of heater blocks, a large division number of heater blocks has an advantage that a heat generation region width can be appropriately changed with respect to various sheet widths. However, there is a trade-off with cost increase or control complexity due to an increase in the number of control temperature sensors is taken into consideration. Therefore, for example, an optimal division number is set according to sheet sizes which can be accommodated in the paper feeding cassettes 18 or sheet widths of several types of sheet sizes which are mainly used by a user.

In a state in which a sheet is not conveyed, for example, during a standby state of the image forming apparatus 10, a temperature reduction occurs in the outermost side end of the heater block located at the outermost side. If such a temperature reduced region at the end of the heater block is used during fixing, defective fixing occurs, and thus a total width of the heater blocks is set to be larger than a sheet width by predicting a temperature reduction at the end of the heater block.

As mentioned above, the heater 152 is divided into a plurality of heater blocks, only a heater block required for fixing is used according to a sheet size, and thus power consumption can be reduced.

A heater block 41 at the center in the width direction is referred to as a first heater block, heater blocks 42*a* and 42*b* located on both sides of the heater block 41 in the width direction are referred to as second heater blocks, heater blocks 43*a* and 43*b* located to be adjacent to both sides thereof are referred to as third heater blocks, and heater blocks 44*a* and 44*b* further located to be adjacent to both sides thereof are referred to as fourth heater blocks. In the heater blocks 41 to 44, a power supply path (not illustrated) for temperature control for each heater block is formed, and a predetermined gap ΔG is formed for separation (insulation) between the heater blocks.

As illustrated in FIG. 5, in the heater 152, a resistance layer 62 is formed on a ceramic substrate 61 provided with a glaze layer as necessary, and electrodes 63*a* and 63*b* are formed on the resistance layer 62. A glass protection layer 64 is further formed. A current is caused to flow to the electrodes 63*a* and 63*b* from the fixing control circuit 154, and thus the resistance layer 62 which is a heat generation body generates heat, so that the temperature of the contact belt 53 can be increased. Sections of the respective heater blocks 41 to 44 have the same structure.

If the temperature sensor 56 is disposed on a lower part of the ceramic substrate 61, the temperature sensor 56 is added as appropriate directly under a heat generation region of which a temperature is to be detected in the belt rotation axis direction, that is, in the longitudinal direction of the ceramic substrate 61. For example, a thermistor is used as the temperature sensor 56.

Figure 6:
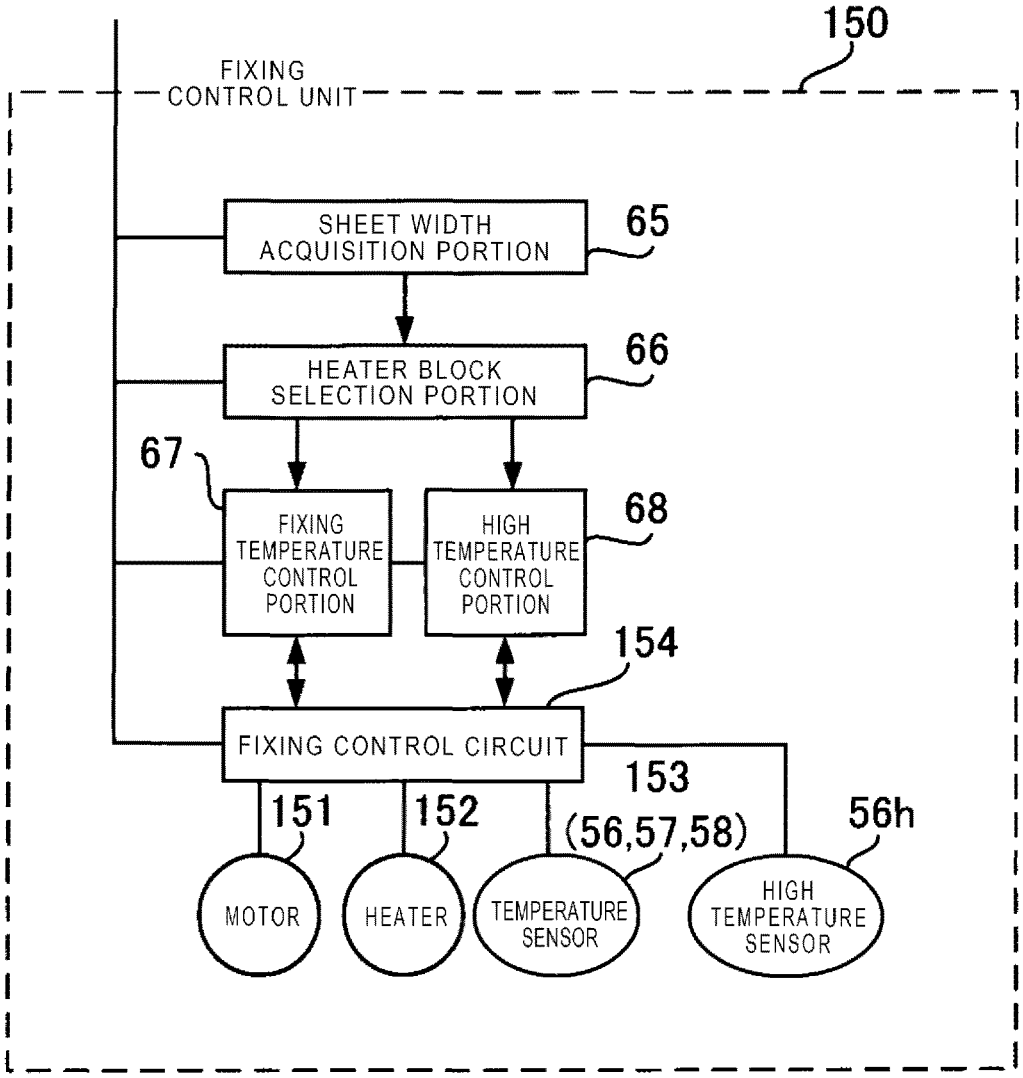
FIG. 6 is a block configuration diagram illustrating a control system of the fixing device.

FIG. 6 is a block configuration diagram illustrating a control system of the fixing device. FIG. 6 illustrates a more detailed configuration than in the block configuration diagram illustrated in FIG. 2. The fixing control unit 150 includes a sheet width acquisition portion 65, a heater block selection portion 66, a fixing temperature control portion 67, a high temperature control portion 68, the fixing control circuit 154, the motor 151, the heater 152, the temperature sensors 153 for controlling the paper passing region to be within a predetermined fixing temperature range, and a high temperature sensor 56*h* for preventing excessive temperature rise in the non-paper passing region. The high temperature sensor 56*h* is the same device as the temperature sensor 56.

The sheet width acquisition portion 65, the heater block selection portion 66, the fixing temperature control portion 67, and the high temperature control portion 68 are implemented as software executed in the CPU 100. On the other hand, the fixing control circuit 154 is configured to control hardware such as the motor 151, the heater 152, the temperature sensors 153, and the high temperature sensor 56*h*.

The sheet width acquisition portion 65 acquires information regarding a sheet width and a conveying position of the conveyed sheet P. Generally, a size of the sheet P, the type of sheet accommodated in the plurality of paper feeding cassettes 18 and an orientation of a sheet are designated by a user using the operation panel 14*a*. Consequently, a sheet width in the width direction orthogonal to the conveying direction of the sheet P is determined. The conveying position of the conveyed sheet P may be determined based on the position of the alignment guides in the paper feeding cassettes. A size of the sheet P and the conveying position of the conveyed sheet P may also be input by the user using the operation panel 14*a* even in a case of manual printing for the sheet P with an atypical size. Alternatively, a sheet width and a conveying position of a conveyed sheet may be determined in real time by using the line sensor 40.

The heater block selection portion 66 determines any heater block to be selected among the plurality of heater blocks 41 to 44 of the heater 152 illustrated in FIG. 4 on the basis of information regarding the sheet width and the conveying position of the conveyed sheet, acquired by the sheet width acquisition portion 65, and causes current to flow to the selected heater block so as to increase a temperature thereof. The selected heater block is used as a heat generation block, and temperature control is performed on the heat generation block. If the sheet P passes over the center (B-B') of the fixing device, the first heater block is necessarily selected.

The fixing temperature control portion 67 performs predetermined temperature control such that the temperature of the paper passing region on the fixing nip N of the fixing device 36 is within a temperature range which is optimal for fixing by using a temperature detection value in the temperature sensor 153 disposed at a position corresponding to the heat generation block. In the present embodiment, it is only necessary to control a fixing temperature of a paper passing region for a heat generation block without defining positions of the temperature sensors 153 and the types (56, 57, and 58) thereof that are used to control the fixing temperature.

The high temperature control portion 68 detects and controls excessive temperature rise in the non-paper passing region on the heat generation block. The high temperature sensor 56*h* for detecting excessive temperature rise is disposed in each of the heater blocks 41 to 44 forming the heater 152. Hereinafter, as an example of a temperature sensor for detecting excessive temperature rise, the high temperature sensor 56*h* located on the rear surface of the heater 152 will be described. The high temperature control portion 68 selects the high temperature sensor 56*h* disposed in a heater block corresponding to a non-paper passing region among heater blocks forming the heat generation block selected by the heater block selection portion 66, and controls excessive temperature rise in the heat generation block. Electric power supply control of a heater block causing excessive temperature rise and safety control such as a reduction of printing speed or printing stoppage are performed before a temperature of the non-paper passing region reaches a predefined temperature.

Hereinafter, a description will be made of an operation of the fixing control unit 150 by using more specific examples. Hereinafter, a description will be made assuming that the sheet P is conveyed over a center of the heater 152 as a reference, but even if the sheet P is conveyed at a position offset from the center of the heater, concepts described herein are still applicable.

Figure 7:
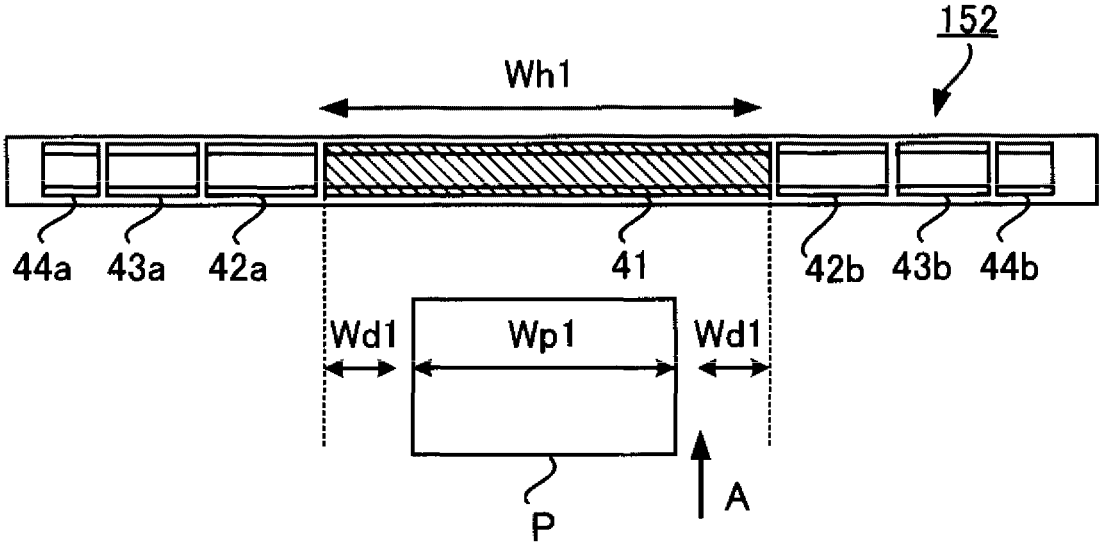
FIG. 7 is an explanatory diagram illustrating a case where a first heater block is selected.

FIG. 7 is a diagram illustrating a case where the first heater block 41 is selected. A block width of the first heater block 41 is indicated by Wh1, and a sheet width of a conveyed sheet is indicated by Wp1.

Figure 8:
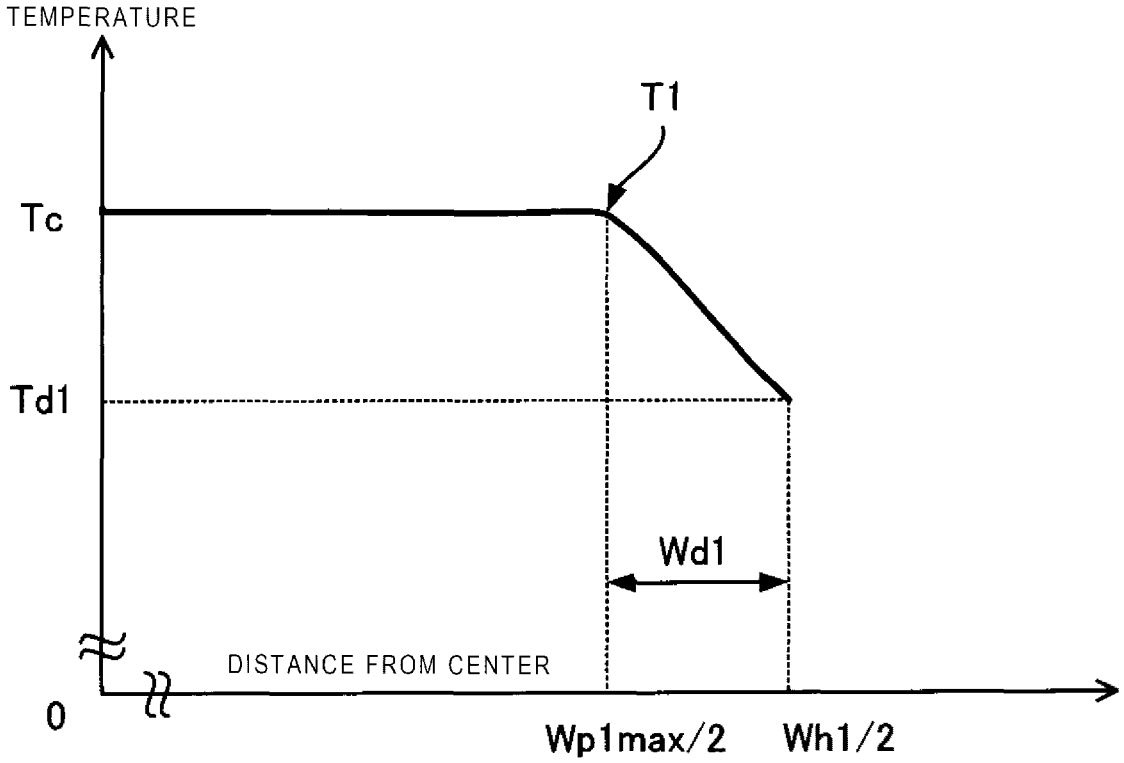
FIG. 8 is an explanatory diagram illustrating a temperature reduction at an end of a first heater block.

FIG. 8 illustrates a temperature reduction curve at the end of a heater block if the first heater block 41 is selected. A longitudinal axis expresses a temperature, and a transverse axis expresses a distance from the heater center. A distance from a temperature reduction start point T1 to the end of the heater block is indicated by Wd1.

As illustrated in FIG. 7, if the sheet P having the sheet width Wp1 smaller than the first heater block width Wh1 is conveyed, the first heater block 41 is selected by taking into consideration the temperature reduction width Wd1 at the end of the heater block.

In other words, as illustrated in FIG. 8, the maximum sheet width Wp1max for selecting the first heater block 41 is determined on the basis of the temperature reduction start point T1. Accordingly, the sheet width Wp1 and the width Wh1 the first heater block 41 satisfy Equation (1).

$$Wp1 \leq Wh1 - 2 \times Wd1 \quad (1)$$

Figure 9:
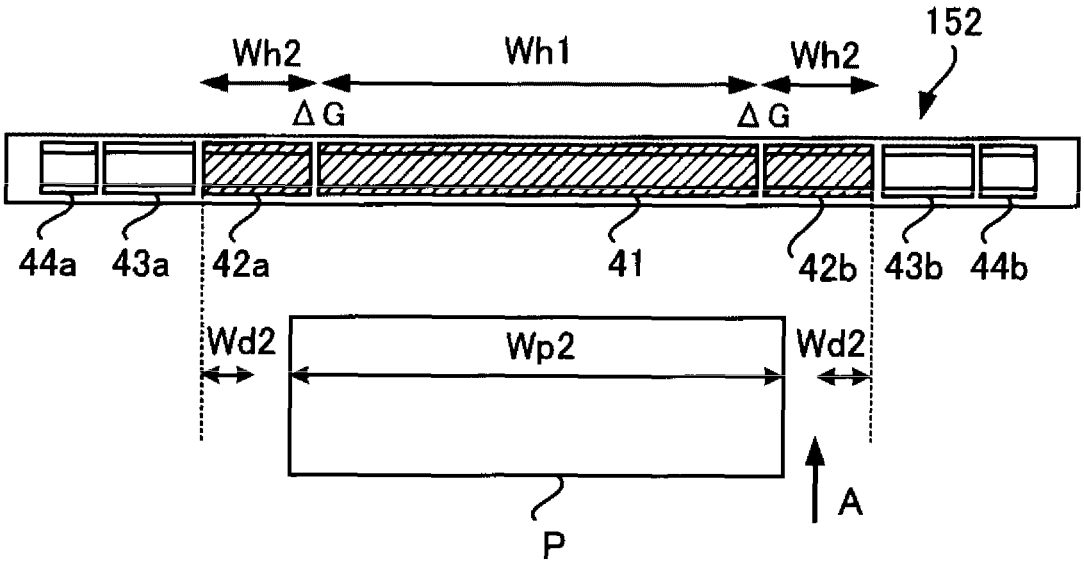
FIG. 9 is an explanatory diagram illustrating a case where the first heater block and a second heater block are selected.

FIG. 9 is a diagram illustrating a case where the first heater block 41 and the second heater blocks 42 are selected. A block width of each of the second heater blocks 42 is indicated by Wh2, and a sheet width of a conveyed sheet is indicated by Wp2. A gap between the first heater block 41 and the second heater block 42 is indicated by ΔG.

Figure 10:
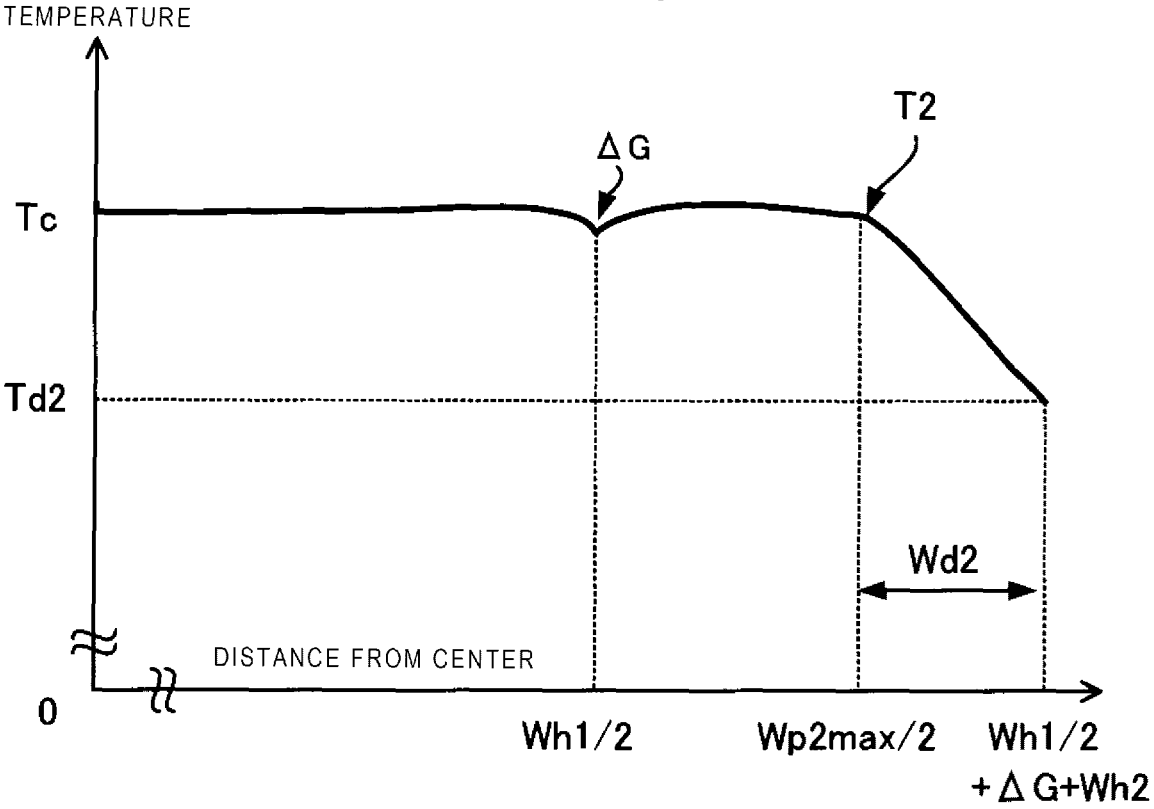
FIG. 10 is an explanatory diagram illustrating a temperature reduction at an end of a second heater block.

FIG. 10 illustrates a temperature reduction curve at the end of a second heater block if the first heater block 41 and the second heater block 42 are selected. A distance from a temperature reduction start point T2 to the end of the heater block is indicated by Wd2.

As illustrated in FIG. 9, if the sheet P having the sheet width Wp2 is conveyed, and the first heater block 41 and the second heater blocks 42 are selected, a region obtained by adding the first heater block width Wh1, the two second heater block widths (2×Wh2), and the two gaps (2×ΔG) together is a heat generation block. The maximum sheet width Wp2max is determined by taking into consideration the temperature reduction width Wd2 at the end of the second heater block.

As illustrated in FIG. 10, the sheet width Wp2 and the widths of the first heater block 41 and the second heater blocks 42 satisfy Equation (2).

$$Wp2 \leq Wh1 + 2 \times (Wh2 + \Delta G - Wd2) (\text{if } Wp2 > Wp1 \text{ max}) \quad (2)$$

The gap ΔG between the heater blocks is determined such that a temperature reduction occurring in this gap does not influence fixing characteristics, and insulating characteristics between the heater blocks are satisfied.

Although not described here, if the first heater block 41 to the third heater blocks 43 are selected, and if the first heater block 41 to the fourth heater blocks 44 are selected, heater blocks corresponding to a width of a conveyed sheet are also selected by using the above-described method.

If consecutive printing is performed by using sheets having the same sheet widths in the image forming apparatus 10, heat absorption in the conveyed sheets is considerable. The fixing temperature control portion 67 controls the temperature of the paper passing region to be within a predetermined temperature range, and, as a result, the temperature of the non-paper passing region increases.

Figure 11:
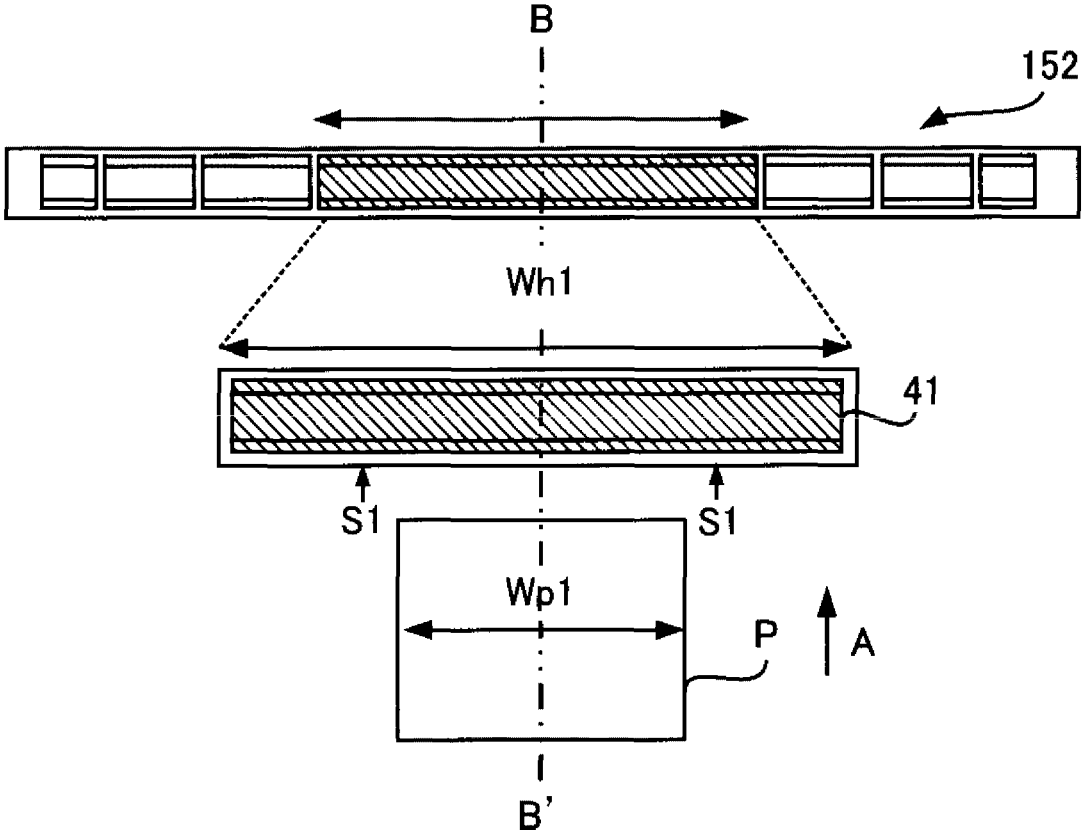
FIG. 11 is an explanatory diagram illustrating a high temperature sensor position if the first heater block is selected.

In the present embodiment, in order to detect the excessive temperature rise, the high temperature sensor 56*h* is provided at an optimal position in each heater block. FIG. 11 is an explanatory diagram illustrating a high temperature sensor position if the first heater block is selected. As illustrated in FIG. 11, if the first heater block 41 is selected for the sheet width Wp1, the high temperature sensor 56*h* is preferably disposed at a position S1 at which a temperature is the maximum in the non-paper passing region.

Figure 12:
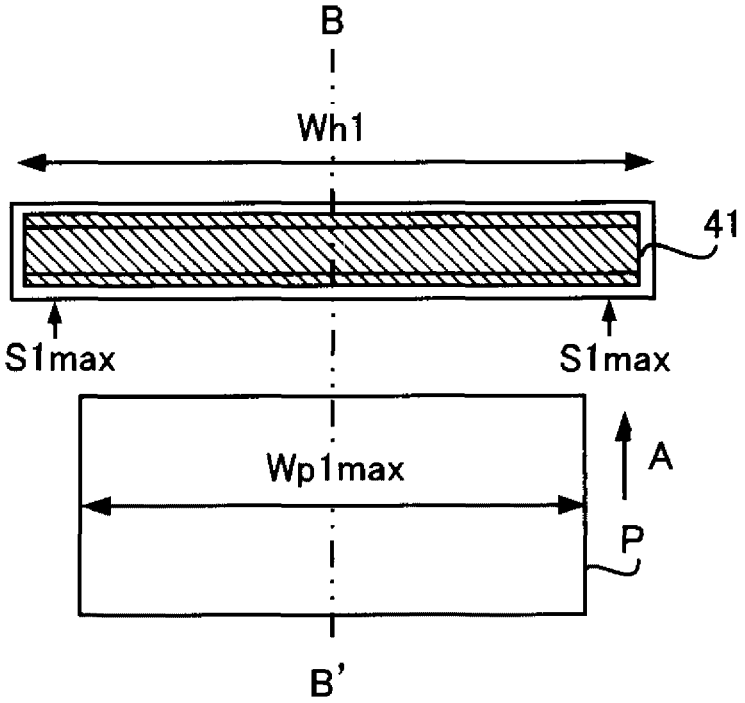
FIG. 12 is an explanatory diagram illustrating a high temperature sensor position for a sheet having the maximum sheet width in the first heater block.

Similarly, as illustrated in FIG. 12, the high temperature sensor 56*h* is preferably disposed at a position S1max at which a temperature is the maximum in the non-paper passing region for the sheet width Wp1max. As mentioned above, generally, positions of the high temperature sensor 56*h* optimal for the sheet width Wp1 are different from each other, and, thus, in the present embodiment, the position of the high temperature sensor at which a high temperature can be detected is determined even if the sheet width Wp1 changes.

First Installation Method

Figure 13:
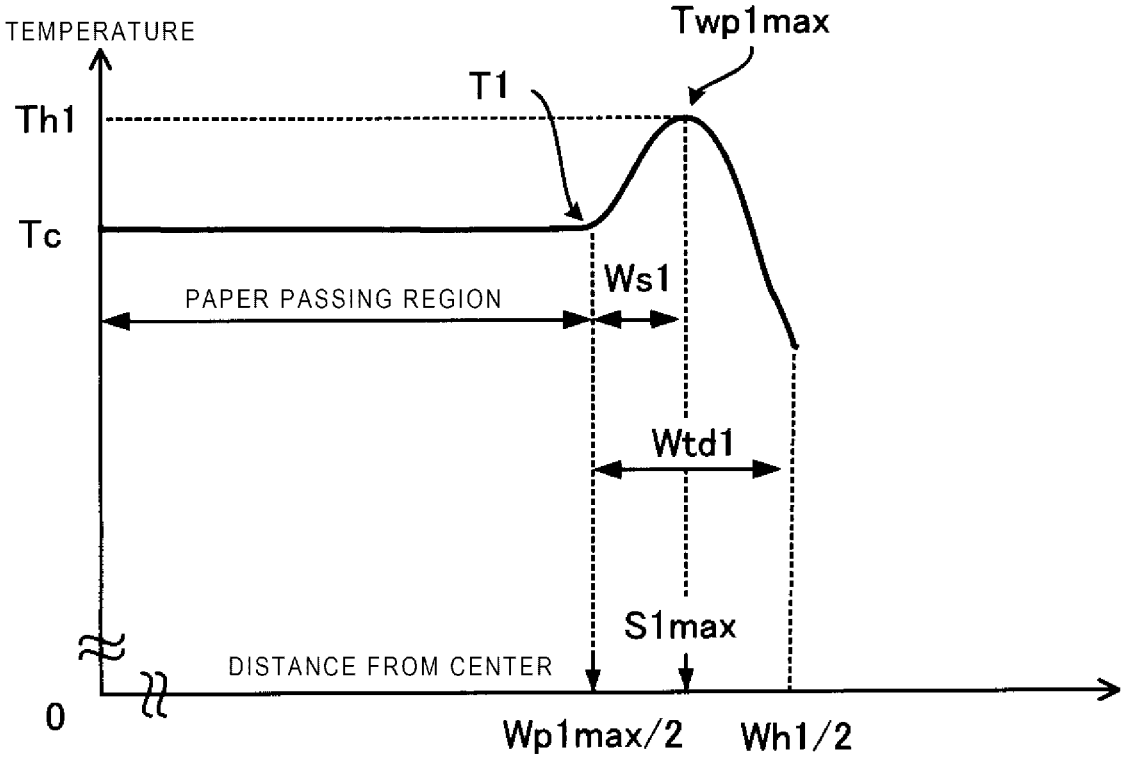
FIG. 13 is an explanatory diagram illustrating a temperature increase in a non-paper passing region for the maximum sheet width.

FIG. 13 is an explanatory diagram illustrating a temperature increase curve of the non-paper passing region for a sheet having a maximum sheet width. Here, an end of a sheet having the maximum sheet width Wp1max is assumed to be the same as the point T1 in FIG. 8.

If the heater center is the origin, a region to the sheet end Wp1max/2 is the paper passing region, and a temperature is controlled to be a substantially constant control temperature Tc. However, in the non-paper passing region, a temperature peak point Tp1max occurs at a point separated from the sheet end Wp1max/2 by Ws1. In this case, the temperature peak point Tp1max occurs within an end temperature reduction width Wd1 of the first heater block 41, and an optimal position of the high temperature sensor 56*h* is a position S1max.

Figure 14:
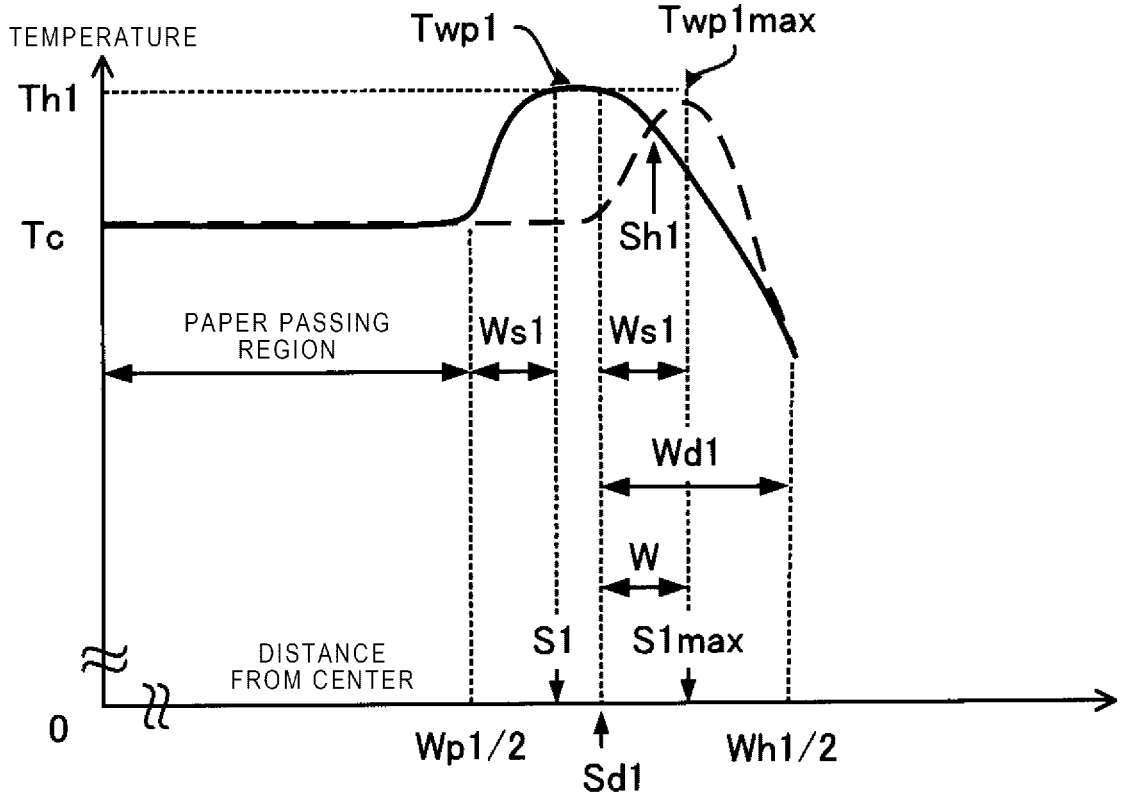
FIG. 14 is an explanatory diagram illustrating a temperature increase in the non-paper passing region for a sheet having a sheet width smaller than the maximum sheet width in the first heater block.

FIG. 14 is an explanatory diagram illustrating a temperature increase curve of the non-paper passing region for a sheet having a sheet width Wp1 smaller than the maximum sheet width. In the same manner as in FIG. 13, a region to the sheet end Wp1/2 is the paper passing region, and a temperature is controlled to be a substantially constant control temperature Tc. In the non-paper passing region, an excessive temperature rise peak point Twp1 occurs at a point (S1) separated from the sheet end Wp1/2 by Ws1, and thus a temperature is reduced at the end of the heat generation block from a point Sd1.

The point Sd1 is a point separated from the end Wh1/2 of the first heater block 41 by the temperature reduction width Wd1. Therefore, an optimal position of the high temperature sensor 56*h* for the sheet width Wp1 is a position between S1 and Sd1. A distance Ws1 from the sheet end to the excessive temperature rise peak is confirmed to be substantially constant through tests regardless of the sheet width Wp1 in the same heat generation block.

If the sheet width Wp1 becomes further smaller, a position of S1 is moved to the left in FIG. 14, but a position of Sd1 does not change much. In both of FIGS. 13 and 14, a position of the high temperature sensor 56*h* at which excessive temperature rise can be detected is in a range of W between Sd1 and S1max, and is preferably an intersection Sh1 between two temperature increase curves indicated by a solid line and a dotted line.

However, in a case of the intersection Sh1, since the high temperature sensor 56*h* is not disposed at the excessive temperature rise peak point, an expected temperature increase curve is obtained, and an expected excessive temperature rise peak temperature is calculated, by using parameters such as a detection temperature, a detection position, the control temperature Tc, the sheet width Wp, the distance Ws1 from a sheet end to an excessive temperature rise peak point, and the end temperature reduction width Wd1 of the high temperature sensor 56*h*. Alternatively, a plurality of high temperature sensors 56*h* may be disposed in the range of W, and an expected value of an excessive temperature rise peak temperature may be calculated through extrapolation on the basis of a plurality of detection temperatures. In this installation method, the maximum sheet width can be effectively used up to the temperature reduction start point T1 at the end of the heat generation block.

Second Installation Method

Unless the maximum sheet width Wp1max is used up to the temperature reduction start point T1 at the end of the heat generation block to the maximum, as illustrated in the temperature increase curve (solid line) in FIG. 14, the high temperature sensor 56*h* may be provided at the position of Sd1 at which the temperature of the end of the first heater block 41 starts to be reduced. According to this method, the temperature of a peak point can be detected by the high temperature sensor 56*h* even if the sheet width Wp1 changes.

Third Installation Method

Figure 15:
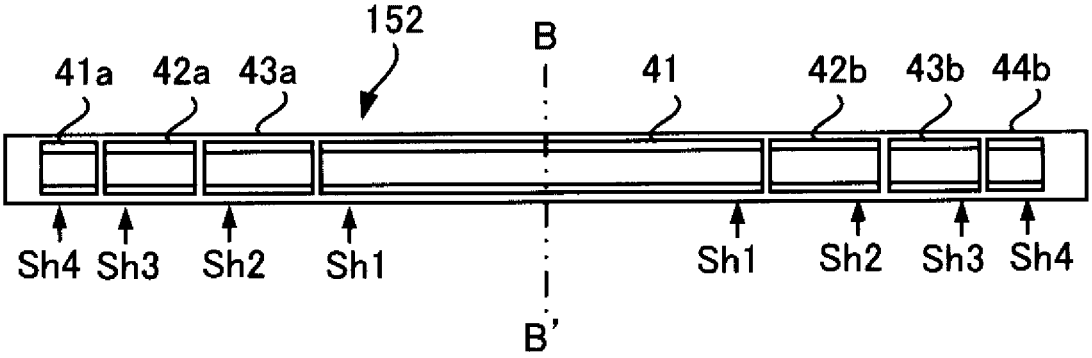
FIG. 15 is an explanatory diagram illustrating positions of high temperature sensors disposed on both sides of the belt width center.

FIG. 15 is an explanatory diagram illustrating a case where the high temperature sensors 56*h* are disposed on both sides of the belt width center (B-B'). In the above description, a case where only the first heater block 41 is selected was described, but the high temperature sensor 56*h* is also disposed in the second heater blocks 42 to the fourth heater blocks 44. In other words, a corresponding heater block is changed by changing the sheet width Wp, and thus a new heat generation block is formed. If the high temperature sensor 56*h* is sequentially arranged in non-paper passing regions of heater blocks corresponding to the non-paper passing regions for the sheet having the maximum sheet width on which the toner image can be fixed among the heat generation blocks, the high temperature sensor 56*h* which can detect excessive temperature rise can be disposed in each heater block.

As illustrated in FIG. 15, the high temperature sensors 56*h* are disposed at positions of Sh1 at both ends in the first heater block 41, and are disposed at positions of Sh2, Sh3, and Sh4 in the second heater blocks 42 to the fourth heater blocks.

During temperature control on a heat generation block, among the high temperature sensors 56*h* in the heat generation block, only the high temperature sensor 56*h* located in a non-paper passing region of the heat generation block is selected, and is used for high temperature control for preventing excessive temperature rise. In this case, the high temperature sensor 56*h* which is not used to detect excessive temperature rise can detect the temperature of the vicinity of the gap ΔG in the heat generation block. Thus, if the high temperature sensor 56*h* is used as the temperature sensor 153 for fixing temperature control, fixing unevenness in the gap ΔG can be reduced.

Fourth Installation Method

Figure 16:
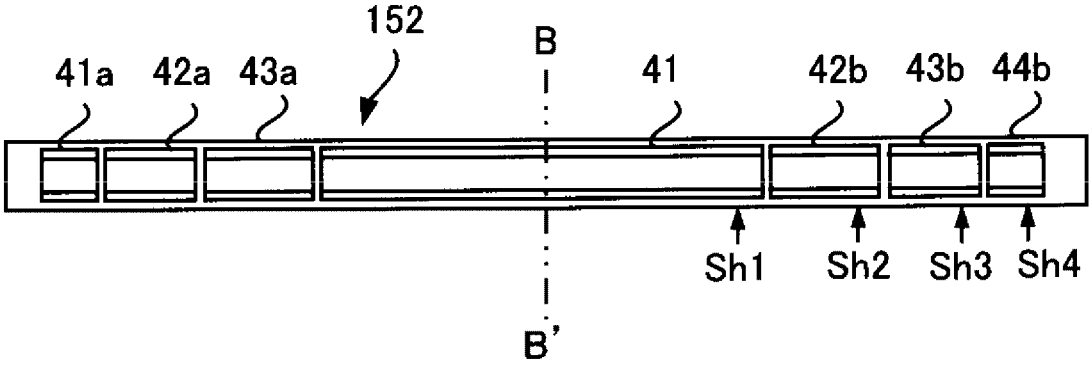
FIG. 16 is an explanatory diagram illustrating a position of the high temperature sensor disposed on one side of the belt width center.

FIG. 16 is an explanatory diagram illustrating a case where the high temperature sensors are disposed on one side of the belt width center (B-B'). If the sheet P is conveyed along the belt center, temperature characteristics which are symmetric with respect to the belt width center, and thus the high temperature sensors 56*h* may be disposed one side with respect to the belt width center. According to this installation method, the number of high temperature sensors 56*h* can be reduced, so as to be able to contribute to simplification of control and low cost.

Fifth Installation Method

In the first to fourth installation methods, the high temperature sensor 56*h* is disposed on the rear surface of the heater 152, but similar installation can also performed by using the temperature sensor 58 for detecting the temperature of the outer circumferential surface 51 and the temperature sensor 57 for detecting the temperature of the inner circumferential surface 52.

Control Flowchart

Figure 17:
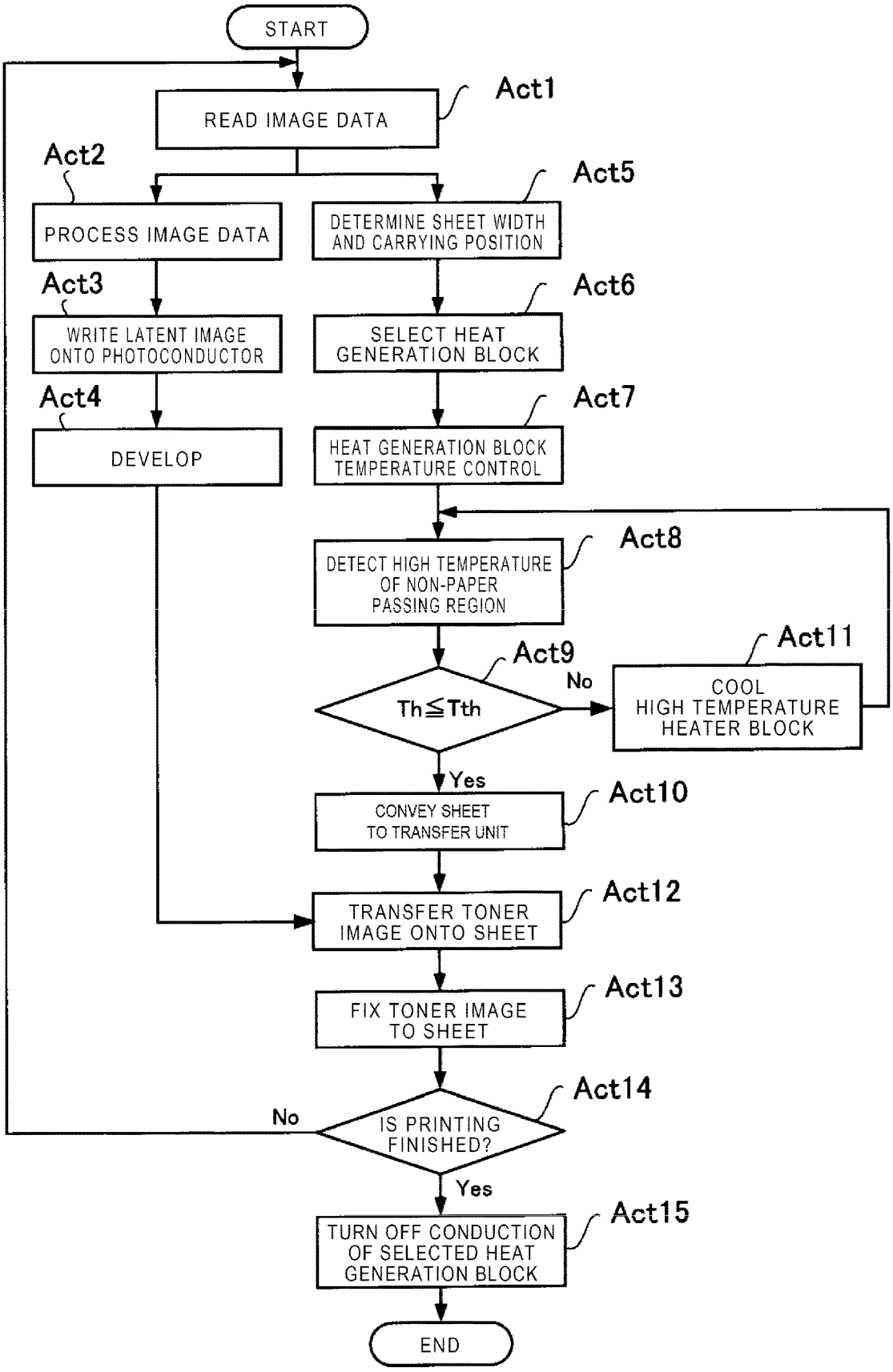
FIG. 17 is a flowchart illustrating a control operation of the image forming apparatus of the embodiment.

Next, with reference to a flowchart of FIG. 17, a description will be made of an operation during printing of the image forming apparatus 10 configured in the above-described way.

First, in Act 1 (operation 1), if the scanner unit 15 reads image data, the CPU 100 executes the image forming control program in the image forming portions 20Y to 20K and the fixing temperature control program in the fixing device 36 in parallel.

If an image forming process program is started, in Act 2, the read image data is processed, and, in Act 3, an electrostatic latent image is written on the surface of the photoconductive drum 22. In Act 4, the developer 24 develops the electrostatic latent image.

On the other hand, in Act 5, if a process of the fixing temperature control program is started, the CPU 100 determines a sheet width and a conveying position of the conveyed sheet P. As described above, the sheet width determination may be performed on the basis of, for example, a detection signal in the line sensor 40 or sheet selection information which is input by a user using the operation panel 14*a*.

In Act 6, the fixing control unit 150 selects a heater block corresponding to the sheet width and the conveying position of the conveyed sheet P, and forms a heat generation block by selecting one or more heater blocks on the basis of, for example, the methods described in FIGS. 7 to 10.

Next, in Act 7, temperature control on the heat generation block is started. Electric power to the heat generation block is supplied such that the temperature thereof is increased, and the temperature of the heat generation block is controlled to be within a fixing temperature range by the fixing temperature control portion 67.

In Act 8, in the heat generation block, the high temperature sensor 56*h* located in a non-paper passing region is selected to be used for high temperature control. For example, if the first heater block 41 and the second heater blocks 42 are selected to form a heat generation block, one or both of the high temperature sensors 56*h* disposed at positions of Sh2 of the second heater blocks 42*a* and 42*b* are selected as the high temperature sensors 56*h*. The high temperature control portion 68 performs temperature detection with the selected high temperature sensor 56*h*, and performs high temperature control by monitoring an temperature increase at the end of the non-paper passing region.

In Act 9, whether or not the detection temperature Th in the selected high temperature sensor 56*h* is lower than a predetermined temperature Tth sufficient to secure performance of a component and safety is determined. Here, if the detection temperature Th is equal to or less than the predetermined temperature Tth, the flow proceeds to Act 10. On the other hand, if the detection temperature Th is higher than the predetermined temperature Tth (Act 9: No), the flow proceeds to Act 11.

In Act 11, in order to prevent a temperature increase in the non-paper passing region, a heater block of which the temperature is high is cooled. Specifically, the CPU 100 performs processes such as (1) reducing a printing rate, (2) temporarily stopping the supply of electric power to the heater block of which the temperature is high, and (3) temporarily stopping a printing process, then returns to Act 8, and performs the processes in this loop by detecting the temperature of the non-paper passing region again until the detection temperature Th is less than or equal to the predetermined temperature Tth.

Next, in Act 10, the CPU 100 causes the paper feeding roller 35 to convey the sheet P to the transfer unit in a state in which the temperature in the non-paper passing region is equal to or less than the predetermined temperature Tth.

In Act 12, the developed toner image in Act 4 is transferred onto the sheet P. The toner image is transferred onto the sheet P, and then the sheet P is conveyed into the fixing device 36.

Next, in Act 13, the fixing device 36 fixes the toner image to the sheet P.

In Act 14, the CPU 100 determines whether or not the image data printing process is finished. Here, if the printing process is determined as being finished (Act 14: Yes), in Act 15, electric power to all of the heater blocks 41 to 44 is stopped, and the process is finished. On the other hand, if the image data printing process is determined as not being finished (Act 14: No), that is, if printing target image data remains, the flow returns to Act 1, and the same process is repeatedly performed until the printing process is finished.

As mentioned above, according to the present exemplary embodiment, since the heater for fixing a toner image to a sheet is divided into a plurality of heater blocks, a minimum necessary heater block can be selected to form a heat generation block according to a conveying position and a sheet width of a sheet. Consequently, an energy saving operation can be achieved.

Since a temperature sensor for detecting excessive temperature rise is disposed in each heater block, excessive temperature rise in a non-paper passing region can be prevented by using a temperature sensor disposed in a heater block corresponding to the non-paper passing region of a heat generation block. In other words, since a block width of a heat generation block is changed according to a sheet width, and a high temperature sensor for detecting excessive temperature rise in the non-paper passing region can be selected in a switching manner, an accurate high temperature control can be performed on sheets having various sheet widths.

Since a high temperature sensor is disposed at an optimal position in each heater block, the accurate high temperature control can be performed on sheets having various sheet widths and using the same heat generation block.

A high temperature sensor not used in a heat generation block can be used for fixing temperature control, and thus fixing unevenness caused by a gap between heater blocks can be prevented.

While certain embodiments have been described, these embodiments have been presented by way of example only, and are not intended to limit the scope of the inventions.

Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heating device, comprising:
an endless belt that contacts a sheet;
a heater in contact with an inner surface of the endless belt;
a plurality of temperature sensors configured to detect temperatures of the heater; and
a processor configured to control electric power supplied to a sheet passing region and a non-sheet passing region of the heater to protect against an excessive temperature rise in the non-sheet passing region based on a temperature detected by at least one of the temperature sensors that are at locations corresponding to the non-sheet passing region.

2. The device according to claim 1, further comprising:
a roller that contacts the endless belt, wherein
the endless belt runs between the roller and the heater.

3. The device according to claim 1, wherein a total number of the plurality of temperature sensors is at least one-half of a total number of heater blocks arranged in the heater.

4. The device according to claim 1, wherein the processor is further configured to acquire a maximum temperature of the non-sheet passing region based on the detected temperatures.

5. The device according to claim 1, wherein each of the temperature sensors is disposed on a surface of the heater, and the heater is located between the temperature sensors and the endless belt.

6. The device according to claim 1, wherein the heater includes a plurality of heater blocks disposed symmetrically with respect to a center of the heater in a longitudinal direction thereof.

7. The device according to claim 6, wherein the plurality of temperature sensors are disposed on the corresponding heater blocks.

8. The device according to claim 6, wherein two adjacent heater blocks are separated by a gap.

9. The device according to claim 6, wherein each of the plurality of temperature sensors is disposed on one of the heater blocks located on one side of the heater with respect to the center of the heater in the longitudinal direction.

10. The device according to claim 1, wherein the processor is further configured to temporarily stop the supply of electric power to the heater based on the detected temperatures.

11. An image processing apparatus, comprising:
a heating device including:
an endless belt that contacts a sheet,
a heater in contact with an inner surface of the endless belt, and
a plurality of temperature sensors configured to detect temperatures of the heater; and
a processor configured to control electric power supplied to a sheet passing region and a non-sheet passing region of the heater to protect against an excessive temperature rise in the non-sheet passing region based on a temperature detected by at least one of the temperature sensors that are at locations corresponding to the non-sheet passing region.

12. The apparatus according to claim 11, further comprising:
a roller that contacts the endless belt, wherein
the endless belt runs between the roller and the heater.

13. The apparatus according to claim 11, wherein a total number of the plurality of temperature sensors is at least one-half of a total number of hearer blocks arranged in the heater.

14. The apparatus according to claim 11, wherein the processor is further configured to acquire a maximum temperature of the non-sheet passing region based on the detected temperatures.

15. The apparatus according to claim 11, wherein each of the temperature sensors is disposed on a surface of the heater, and the heater is disposed between the temperature sensors and the endless belt.

16. The apparatus according to claim 11, wherein the heater includes a plurality of heater blocks disposed symmetrically with respect to a center of the heater in a longitudinal direction thereof.

17. The apparatus according to claim 16, wherein the plurality of temperature sensors are disposed on the corresponding heater blocks.

18. The apparatus according to claim 16, wherein two adjacent heater blocks are separated by a gap.

19. The apparatus according to claim 16, wherein each of the plurality of temperature sensors is disposed on one of the heater blocks located on one side of the heater with respect to the center of the heater in the longitudinal direction.

20. A method of controlling a heating device including an endless belt that contacts a sheet, a heater in contact with an inner surface of the endless belt, and a plurality of temperature sensors, the method comprising:
detecting temperatures of the heater using the temperature sensors; and
controlling electric power supplied to a sheet passing region and a non-sheet passing region of the heater to protect against an excessive temperature rise in the non-sheet passing region based on a temperature detected by at least one of the temperature sensors that are at locations corresponding to the non-sheet passing region.

* * * * *